United States Patent [19]

Boardman

[11] Patent Number: 4,550,881

[45] Date of Patent: Nov. 5, 1985

[54] SCRAP SCROLLER FOR A SHEAR DISCHARGE CONVEYING SYSTEM

[75] Inventor: Peter W. Boardman, St. Catharines, Canada

[73] Assignee: Deere & Company, Moline, Ill.

[21] Appl. No.: 555,767

[22] Filed: Nov. 28, 1983

[51] Int. Cl.[4] ..... B65H 19/20

[52] U.S. Cl. ..... 242/56 R; 83/155

[58] Field of Search ..... 242/56 R, 56.6, 81, 242/65, 78.1; 83/155; 198/690

[56] References Cited

U.S. PATENT DOCUMENTS

| | | | |
|---|---|---|---|
| 1,757,772 | 5/1930 | Johnson | 242/81 |
| 3,527,425 | 9/1970 | Shumaker | 242/78.1 |
| 3,690,583 | 9/1972 | Herman | 242/79 X |
| 4,099,682 | 7/1978 | Benuska | 242/67.1 R X |
| 4,285,475 | 8/1981 | Rogers | 242/56.2 |
| 4,372,538 | 2/1983 | Balfanz | 198/690 X |

FOREIGN PATENT DOCUMENTS

| | | | |
|---|---|---|---|
| 2512361 | 3/1983 | France | 83/155 |

OTHER PUBLICATIONS

T896,049, Decker et al., Defensive Publication, 0.6 vol. No. 896, Number Series 049, printed 3-28-72.

*Primary Examiner*—Stephen Marcus
*Assistant Examiner*—Leo J. Peters

[57] ABSTRACT

Scrap material cut by a shear is gripped by a vertically and transversely movable scrap-gripping and conveying mechanism which feeds the strip generally parallel to the back side of the shear into a pinch roll drive. The scrap is then fed into a slot of a scroll spindle. The spindle is rotated, and the scrap wraps around the spindle into a compact cylindrical package. Once the scrap is entirely rolled on the spindle, the spindle is retracted by a cylinder, and the scrap is pushed off the end of the spindle and falls into a storage area.

32 Claims, 11 Drawing Figures

SCRAP SCROLLER FOR A SHEAR DISCHARGE CONVEYING SYSTEM

BACKGROUND OF THE INVENTION

This invention relates generally to a shear discharge conveying system and more specifically to a scrap scroller for compacting scrap material cut from a shear.

Conventional shear discharge conveying systems typically dispose of scrap material cut from the shear by moving the scrap away from the shear on flighted conveyors and directing the scrap downwardly toward the floor by opening a scrap door at the end of the conveyors. An example of this type of system is shown in U.S. Pat. No. 3,670,611. Several problems exist with the prior art systems for moving scrap away from the shear. As the scrap is cut, it tends to drop on the conveyors with the first cut end often curved away so that it is supported at a poor angle on the conveyors. The end tends to work its way under the flights causing blockages of the conveyors and often resulting in a broken conveying chain. The bent end also often gets caught under a support arm which is utilized to support the material as it is being gauged. The scrap can often become distorted so that it slips on the conveyor and is not conveyed to the end of the conveyor. It is not uncommon for the distorted scrap material to pass over the scrap gate especially when the scrap is improperly oriented on the conveyor. Scrap handled in the conventional manner may be bulky and difficult to move.

It is therefore an object of the present invention to provide an improved scrap-handling system for a shear discharge conveying system.

It is a further object of the present invention to provide an improved scrap-handling system which reduces or eliminates the above-described problems.

It is yet another object of the invention to provide a scrap-handling system for a conveyor which eliminates improper orientation of the scrap on the conveyor, prevents scrap from slipping on the conveyor, and prevents scrap from working its way under the conveyor belt or chain.

It is another object of the invention to provide an improved scrap-handling system for a shear conveyor which eliminates the need for a scrap gate and reduces the incidences of scrap exiting the conveyor other than at the scrap bin area.

It is a further object of the invention to provide a scrap-conveying system for a shear which provides an improved, compact scrap configuration to reduce the storage area required. It is also an object to provide such a system which utilizes a minimum amount of space adjacent the shear.

It is a further object of the present invention to provide a scrap scrolling device for removing scrap directly from the rear of a shear.

In accordance with the above objects, a movable scrap-gripping and conveying mechanism is provided adjacent the back side of a shear to move strips of scrap material parallel to the shear blade and generally transverse to the conveying direction.

The strip of scrap is guided into a pinch roll supported on the side frame of the conveyor. The pinch roll moves the strip into a slotted scroll spindle which is rotated to wrap the scrap into a compact, cylindrical package. Once the entire piece of scrap is rolled on the spindle, a hydraulic cylinder retracts the spindle so that the piece of scrap slides off the scroll into a storage area.

The scrap scroller removes scrap directly from the shear and reduces it in size to eliminate handling problems such as scrap slipping on the conveyor or getting under the conveyor belts or chains. There is no need for a scrap gate located at the end of the conveyor, and by removing the scrap before contacting the conveyor, conveyor downtime resulting from scrap-related problems are reduced or eliminated. By rolling the scrap at the side frame of the shear, very little space is required for the scrap-handling system including the scrap storage bin.

These and other objects, features and advantages of the present invention will become apparent to those skilled in the art from the description which follows and from the drawings.

DESCRIPTION OF THE PREFERRED EMBODIMENT

Figure 1:
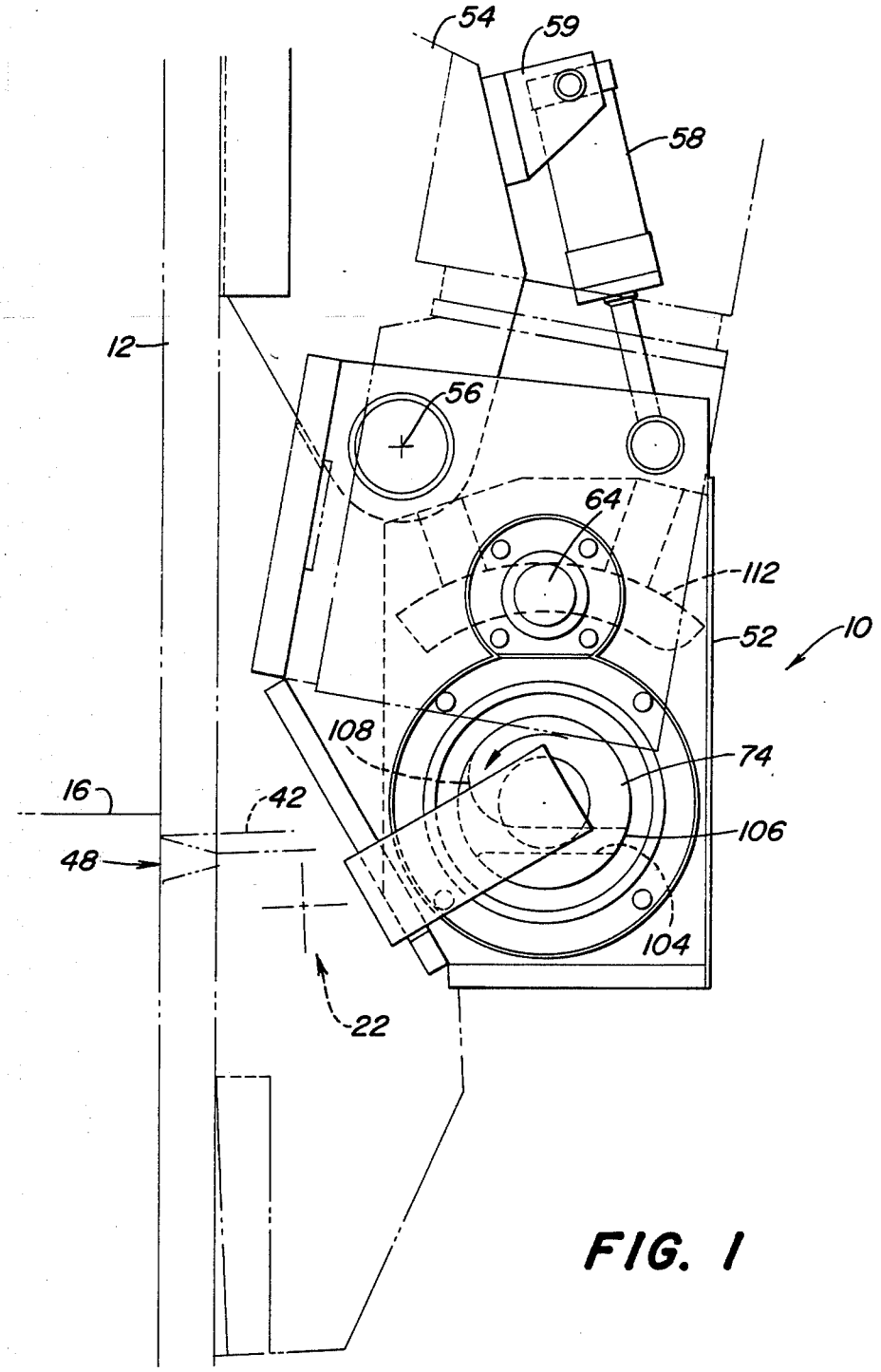
FIG. 1 is a side elevation of the scrap scroller of the present invention.
Figure 5:
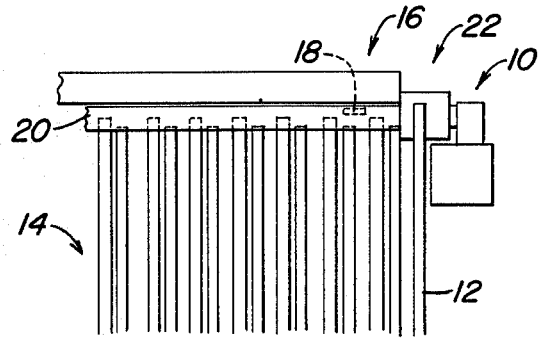
FIG. 5 is a top view of a portion of a conveying system showing the scrap-gripping and conveying mechanism moving a piece of scrap to the scrap scroller.

Referring now to FIG. 1, therein is shown a scrap scroller 10 connected to the side frame 12 of a conventional metal shear 16. A discharge conveying system 14 (FIG. 5) moves cut material rearwardly from the shear. The scroller 10 is located rearwardly adjacent the shear line of the shear 16 with the front portion of the scrap scroller aligned with the shear blade. A scrap-gripping and conveying mechanism 18 is located closely adjacent the rear side of the shear and is movable along the back side of the shear generally parallel to the shear blade. When a strip of scrap metal, such as shown at 20 in FIG. 5, is cut by the shear 16, the mechanism 18 which includes a magnetic gripping head 230 is activated and grips the lower side of the strip 20 preventing it from falling onto the discharge conveying system 14. The mechanism 18 begins to move the gripped scrap 20 to the right as viewed in FIG. 5 into a pinch roll drive 22 located adjacent the shear. The drive 22 grabs the transversely conveyed scrap 20 and conveys it further in the same direction into the scroller 10 where it is rolled into a compact scroll.

Figure 3:
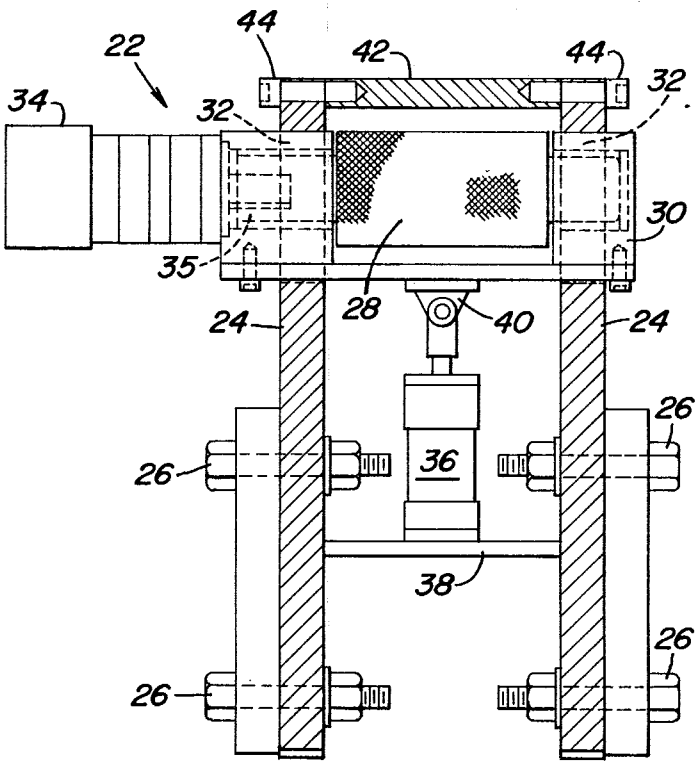
FIG. 3 is a sectional view taken along lines 3—3 of FIG. 2.
Figure 2:
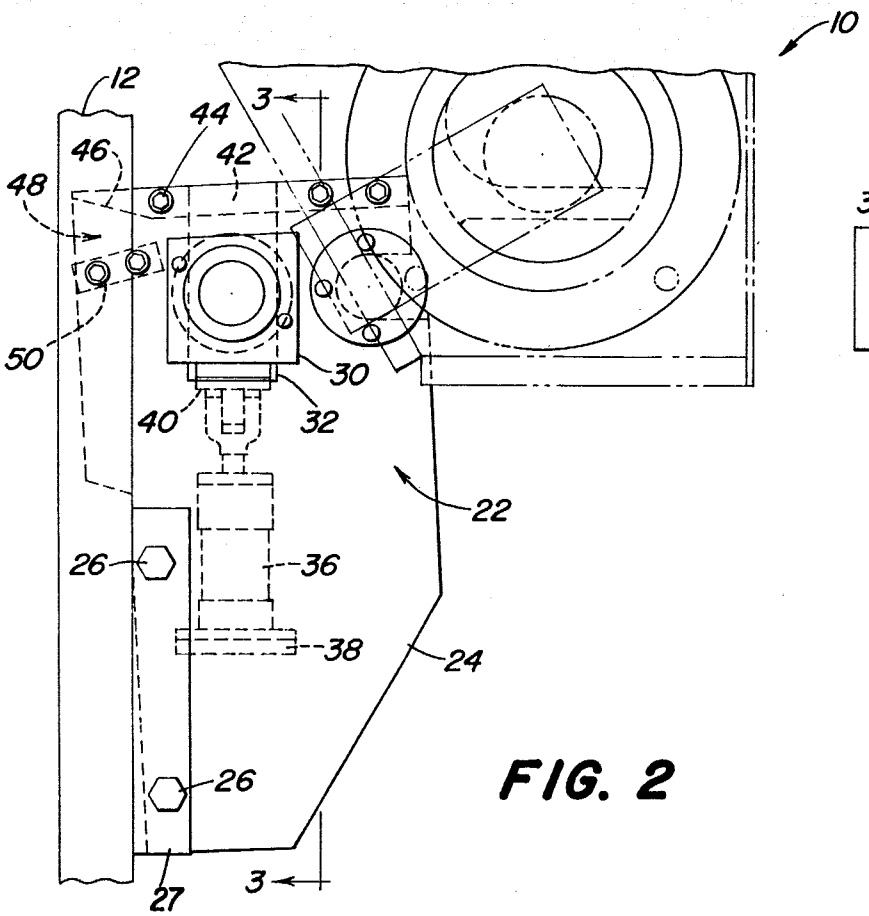
FIG. 2 is an enlarged view of a portion of the scrap scroller shown in FIG. 1 and showing the pinch roll drive.

As best seen in FIGS. 2 and 3, the pinch roll drive 22 is supported on the side frame 12 of the shear by fore-and-aft spaced side plates 24. The side plates 24 are connected by bolts 26 to brackets 27 fixed to the side frame 12. A roller 28 having a diamond knurl surface is journalled for rotation in a support member 30 movably mounted in vertical slots 32 formed in the top portion of the side plates 24. A hydraulic motor 34 is mounted on the support member 30 and is drivingly connected to the roller 28, preferably through a friction drive 35. A hydraulic cylinder 36 has its base end connected to a horizontal plate 38 extending between the side plates 24. The rod end of the cylinder 36 is connected to a bracket 40 fixed to the bottom of the support member 30. An upper guide member 42 is fixed between the tops of the side plates 24 by bolts 44. The portion of the guide member 42 located adjacent the shear 16 is angled upwardly at 46 and defines a strip-receiving opening 48 with a fixed guide member 50. The opening 48 converges rearwardly (that is, to the right as viewed in FIG. 2) at a location generally aligned with the top of the roller 28 when the support member 30 is in the lowermost position. The scrap-gripping and conveying mechanism 18 is moved along the back side of the shear a sufficient amount to direct the scrap 20 into the opening 48. The cylinder 36 is then extended to move the surface of the roller 28 into contact with the bottom of the strip 20. The gripping head 230 on the mechanism 18 is deactivated, and the motor 34 is activated to move the pinched strip 20 to the scrap scroller 10.

Figure 11:
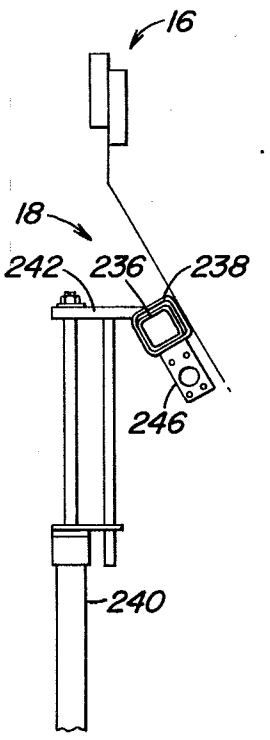
FIG. 11 is a view similar to FIG. 10, but showing more clearly the vertical adjusting member and the sliding beam arrangement of the gripping mechanism.
Figure 10:
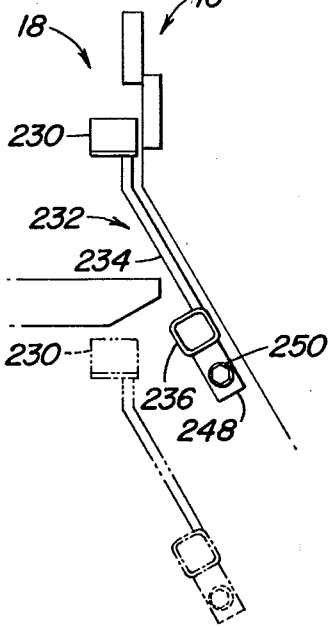
FIG. 10 is an end view of the mechanism of FIG. 9 showing the relative positions of the mechanism when it is in its raised operative position and its lowered retracted position.
Figure 9:
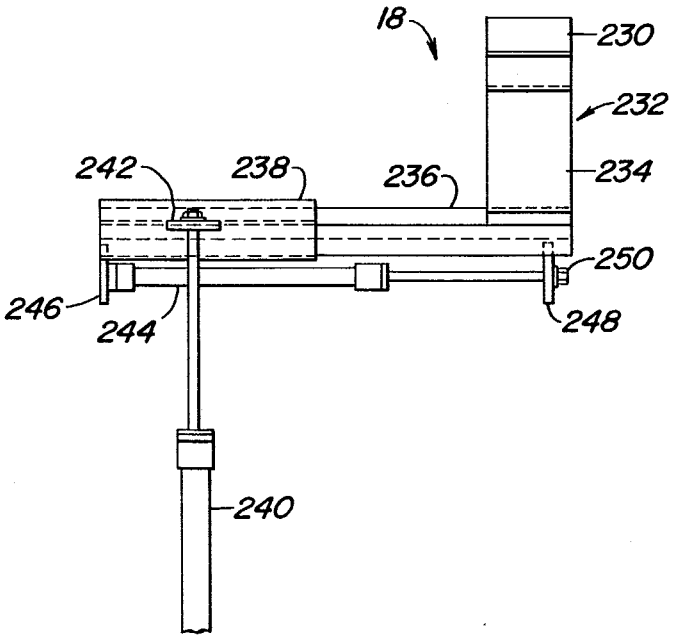
FIG. 9 is a front view of the scrap gripping and conveying mechanism utilized with the system of FIG. 5.

The movable scrap gripping and conveying mechanism 18 is movable between a retracted position, shown by the broken lines in FIG. 10, to a raised position, as shown by the solid lines in FIG. 10, immediately adjacent the back of the shear 16. The magnetic head 230 is supported on a carriage arm 232 which includes an angled plate 234. As best seen in FIG. 10, the plate 234, when the head 230 is raised to the operative position, conforms generally to the shape of the rear of the shear 16 and lies closely adjacent to the shear with the head 230 directly under the shear blade at dwell on breakthrough. The angled plate 234 is welded to the top corner of a sliding beam 236 having a generally square cross section and slidingly received within a slightly larger tubular beam 238. The beam 238 is supported for vertical movement closely adjacent the rear side of the shear 16 by a pair of cylinders 240 transversely spaced along the back side of the shear. Each cylinder 240 is connected to the beam 238 by a bracket 242 welded to the front corner of the beam 238. The carriage arm 232 is movable transversely, that is, in and out of the plane of the FIGS. 10 and 11, by a horizontally disposed cylinder 244 fixed at its base end to the beam 238 by a bracket 246. The rod end of the cylinder 244 is connected to a bracket 248 welded to the end of the sliding beam 236 adjacent the attachment thereto of the magnetic carriage arm 232. The rod end of the cylinder 244 is secured to the bracket 248 by a nut and washer indicated at 250.

Prior to a narrow piece of scrap being cut from the metal sheet by the shear 16, the cylinders 240 are extended to raise the magnetic gripping head 230 closely adjacent the shear line as shown in FIG. 10 by the solid lines. The head 230 grips the metal strip as it is sheared from the remainder of the sheet. Once the strip is gripped by the head 230, the cylinder 244 is activated to slide the beam 236 within the corresponding beam 238 to move the strip of scrap transversely away from the shear 16. The mechanism 18 prevents scrap material from contacting the conveying surface and moves the scrap towards the side frame 12.

The scrap scroller 19 includes a scroller frame 52 hinged to upright bracket structure 54 for rocking about a pivot 56 offset vertically from the upper guide member 42. The pivot 56 is substantially transverse to the axis of the cutting blade of the shear 16. A hydraulic cylinder 58 has its base end pivotally connected to a bracket 59 which in turn is fixed to the bracket structure 54. The rod end of the cylinder 58 is pivotally connected to the upper portion of the scroller frame 52 outwardly of the pivot 56. By retracting the cylinder 58, the scrap scroller 10 may be rocked away from the pinch roll drive 22 to provide a clearance area between the scroller and the drive.

Figure 4:
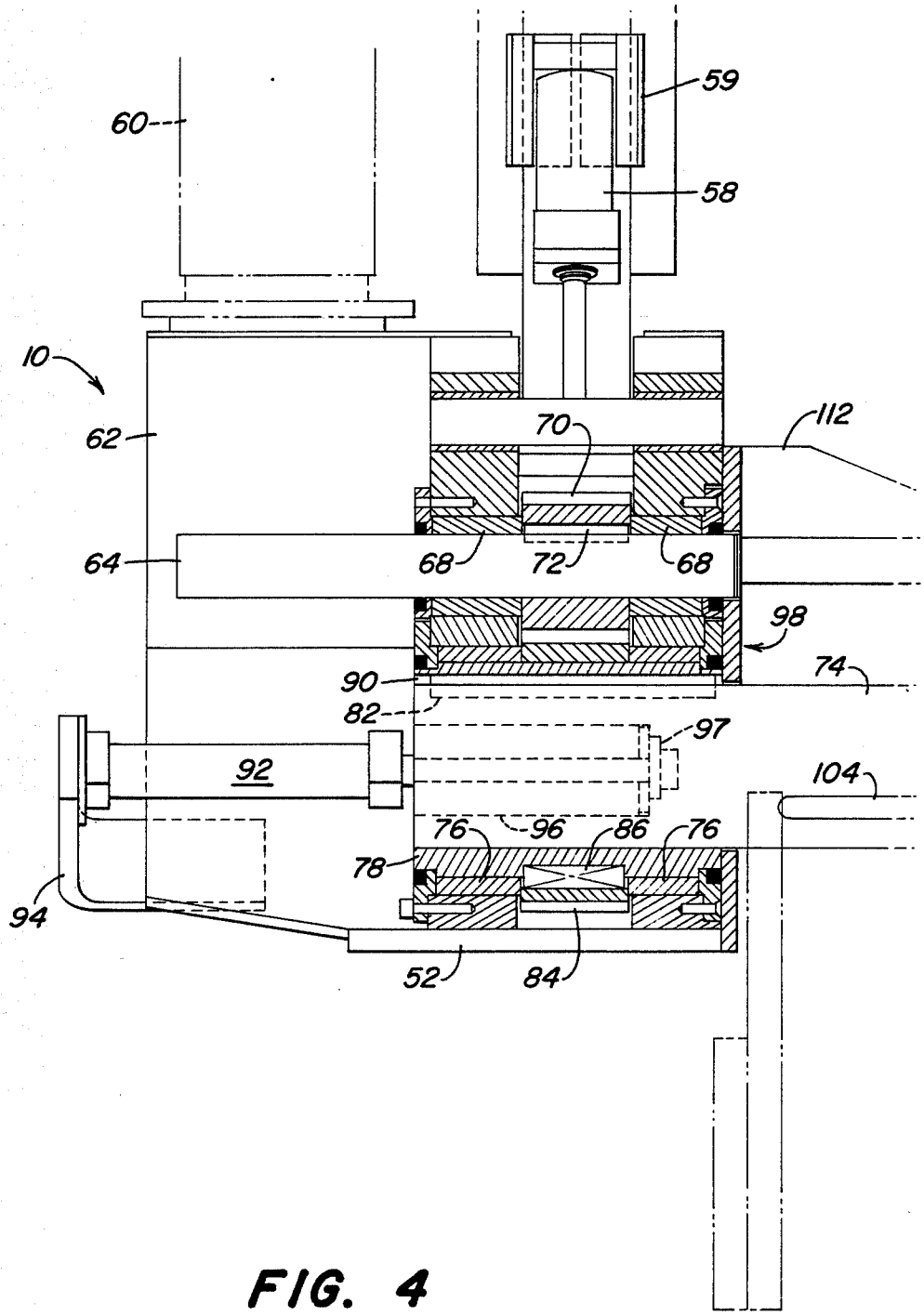
FIG. 4 is a sectional view of the scroll spindle gear drive.

The scroller frame 52 supports a drive motor 60 having a gear box 62 which is drivingly connected to a motor drive shaft 64. The drive shaft 64 is supported for rotation in the frame 52 by bearings 68. The shaft 64 is drivingly connected to a gear 70 by a key 72. A scroll spindle 74 is supported in the frame for rotation about an axis generally parallel to the axis of the drive shaft 64 by a spindle bearing 76. The spindle 74 is slidably mounted within a sleeve 78 but is constrained for rotation with the sleeve 78 by a key 82. A drive gear 84 is mounted on the central portion of the sleeve 78 and is constrained for rotation with the sleeve by a key 86. The drive gear 84 meshes with the gear 70 to rotate the spindle 74. The sleeve 78 is axially slotted at 90 to permit the spindle 74 and the key 82 to slide axially to the left as viewed in FIG. 4.

A scroll strip cylinder 92 is anchored at its base end by a bracket 94 to the scroller frame 52. The cylinder 92 is axially aligned with the scroll spindle 74, and the rod end of the cylinder is connected to the innermost end of a cylindrical recess 96 by connecting structure indicated generally at 97 which permits relative rotation between the cylinder rod and the spindle 74. The diameter of the cylindrical recess 96 is sufficient so that as the rod is retracted, the cylinder end of the cylinder 92 will be accommodated within the recess 96. The stroke of the cylinder 92 is selected so that when completely retracted, the outermost end of the scroll spindle 74 (that is, the right end as viewed in FIG. 4) will be approximately aligned with the outward face indicated at 98 of the frame 52 adjacent the spindle. The outward face 98 acts as an abutment surface which contacts the scrolled scrap as the spindle 74 is retracted.

The spindle 74 includes a strip-receiving slot 104 which extends axially from adjacent the outward face 98, when the spindle is in the extended position, through to the outermost end of the spindle. The slot extends substantially radially through the spindle 74 (FIG. 1) but dead-ends adjacent the circumference of the spindle at a location indicated generally at 106 in FIG. 1. The opposite end of the slot 104 is tapered at location 108 to define a guiding opening which aligns with the strip-receiving opening 48 of the pinch roll drive 22. The taper at 108 also aids in starting a neat, compact scroll when the spindle is rotated in the forward direction (arrow). An arc-shaped ironing attachment 112 extends outwardly over the scroll spindle 74 to help conform the end of the scroll of scrap metal to the remainder of the scroll.

Figure 6:
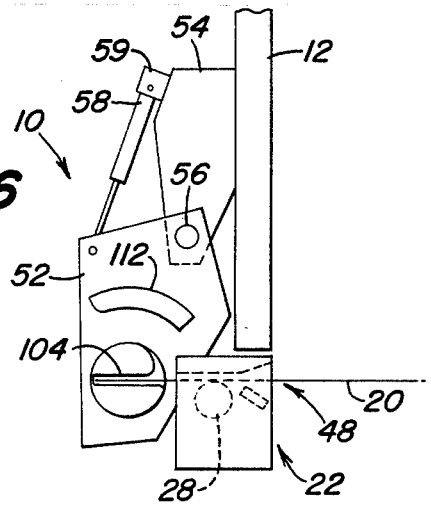
FIG. 6 is a side view of the scrap scroller of FIG. 5 with a piece of scrap being positioned within the slot on the spindle of the scroller.
Figure 7:
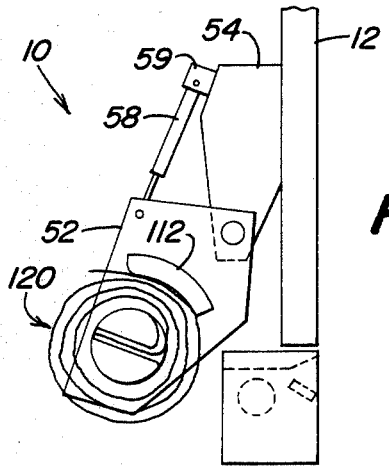
FIG. 7 is a view similar to FIG. 6 but showing the scrap metal wound into a compact configuration around the spindle.
Figure 8:
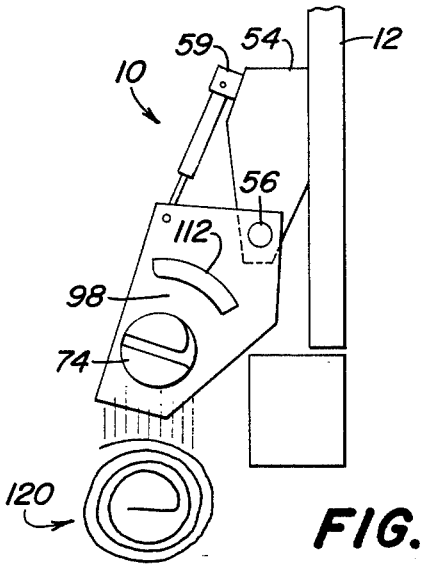
FIG. 8 is a view similar to FIG. 7 but showing the scroll spindle retracted by the strip cylinder to remove the scroll.

In operation the shear blade of the shear 16 is activated to cut a strip of scrap metal 20 (FIG. 5) from the remainder of a metal sheet. The scrap-gripping and conveying mechanism 18 is immediately activated to grip the strip 20 before it touches the conveyor of the shear discharge conveying system 14. The mechanism 18 then moves the strip 20 generally parallel to the shear blade and into the opening 48 of the pinch roll drive 22. The cylinder 36 is extended so that the knurled surface of the roller 28 firmly contacts the bottom of the strip 20 at which time the gripping head of the mechanism 18 is deactivated and the hydraulic motor 34 is activated. The motor 34 quickly accelerates the strip 20 into the spindle slot 104 of the extended spindle 74. The end of the strip 20 dead-ends against the location 106 to stop the strip. The motor 34 is stopped, and the drive motor 60 of the scrap scroller 10 is activated to rotate the spindle 74 to wind the strip 20 onto the scroll 74. As the spindle 74 rotates, the strip is drawn toward the left (FIGS. 6 and 7) away from the shear and onto the spindle until the far end of the strip 20 is pulled completely through the pinch roll drive 22. While the strip 20 is wrapping around the spindle 74, the cylinder 58 may be retracted as necessary to prevent the scrolled scrap from contacting the pinch roll drive frame as the scroll enlarges in diameter. Once the end of the strip 20 is pulled through the pinch roll drive 22, the arc-shaped ironing attachment 112 presses the end against the remainder of the scroll so that a compact package of scrap, indicated generally at 120 in FIGS. 7 and 8, is formed. Once the strip 20 is formed into the compact scroll 120 on the scroll spindle 74, the motor 60 is stopped and the cylinder 92 is retracted so that the inner edge of the scrolled strip 20 contacts the abutment surface formed by the outward face 98. The cylinder 92 is completely retracted so that the scrolled scrap 120 is stripped from the spindle 74 and falls to a scrap container (not shown) below the scrap scroller 10. During the step of stripping the scrap 120, the cylinder 58 is preferably maintained in a retracted position so that the scrap can fall unrestricted into the container. The motor 60 is advanced to a position wherein the slot 104 is generally horizontal and aligned with the opening 48 of the pinch roll drive 22 for receiving the next strip of scrap material to be scrolled. Once the compact scrolled scrap 120 is removed from the scrap scroller 10, the cylinder 58 is extended to bring the scroll spindle 74 adjacent the pinch roll drive 22 as shown in FIG. 6.

Having described the preferred embodiment, it will be apparent that modifications can be made without departing from the scope of the invention as defined in the accompanying claims.

I claim:

1. In a conveying system for a shear having an elongated shear blade and a conveyor for moving cut metal in a preselected direction from the shear, a scrap scroller for moving strips of scrap metal cut from the shear away from the conveyor and compacting the strips, the scroller comprising:

a scroller frame located adjacent the shear;

a spindle rotatably mounted in the frame adjacent and offset to one side of the shear blade for rotation about an axis generally transverse to the shear blade and parallel to the preselected conveying direction, said spindle including a strip-receiving portion;

means for moving the strip parallel and adjacent to the shear blade;

guide means for directing one end of the metal strip into the receiving portion;

means for rotating the spindle to wind the strip in a compact scroll onto the spindle; and means providing relative axial movement between the scroll of metal and the spindle for removing the scroll from the spindle.

2. The invention as set forth in claim 1 wherein the spindle is shiftable axially, and the means for removing the scroll includes an abutment surface located adjacent the spindle and means for shifting the spindle to engage the scroll against the abutment surface.

3. The invention as set forth in claim 1 wherein the scroller frame is connected for pivoting about an axis offset from the spindle axis and wherein the scroller further includes means for rocking the scroller frame about the pivotal axis to move the spindle away from the guide means.

4. The invention as set forth in claim 3 wherein the scroller further includes a drive motor supported by the scroller frame, drive gear means supported by the scroller frame for transmitting drive from the drive motor to the spindle, said drive motor and drive gear means rockable with the frame as it is rocked about its pivotal axis.

5. The invention as set forth in claim 1 wherein the means for moving the strip comprises a movable scrap-gripping mechanism located behind the shear and shiftable in a direction parallel to the shear blade to move the strip to the guide means.

6. The invention as set forth in claim 5 wherein the guide means includes a pinch roller; and means for driving the pinch roller to urge the strip into the spindle slot.

7. A method for handling strips of scrap metal cut by an elongated shear, the method comprising:

(a) gripping one end of a strip of scrap material as it is being cut (b) moving the strip generally parallel to the elongated shear (c) directing one end of a strip of scrap material into contact with an elongated spindle having an axis of rotation generally perpendicular to the shear and located at one end of the shear;

(d) rotating the spindle about the axis of rotation to wind the strip onto the spindle and thereby draw said strip in the direction of said one end of the shear; and (e) removing the wound strip from the spindle adjacent said one end of the shear.

8. The method as set forth in claim 7 wherein step (a) includes moving the end of the strip into a slot which extends axially through to one end of the spindle, said step of rotating the spindle including capturing the strip end.

9. The method as set forth in claim 8 wherein step (c) includes stripping the wound strip off said one end of the spindle.

10. The method as set forth in claim 8 including locating a pinch roller adjacent one side of the shear, and wherein the step (a) includes driving a pinch roller in contact with the strip.

11. The method as set forth in claim 10 further including the steps of gripping the strip as it is cut by the shear and thereafter moving the gripped strip onto the pinch roller.

12. A method for handling a strip of scrap material cut from a sheet of material by a metal shear having a side frame and an elongated cutting blade having one end located adjacent the side frame, the method comprising the steps of:

(a) gripping the strip of material as the strip is severed from the sheet;

(b) moving the strip of material closely adjacent the cutting blade in a direction generally parallel to the longitudinal axis of the blade toward the side frame of the shear; and (c) rolling the strip of material into a compact scroll adjacent the side frame.

13. The method as set forth in claim 12 wherein step (a) includes activating a gripping mechanism adjacent the cutting blade to positively grip and hold the strip.

14. In a conveying system for a shear, scrap-handling structure for removing and compacting narrow strips of material cut by the shear, each strip having a major axis extending in a preselected direction generally parallel to the shear, said scrap-handling structure comprising:

a scrolling mechanism located closely adjacent the shear, said mechanism including a rotatable spindle having an axis of rotation offset to one side of the shear and generally perpendicular to the axis;

means for moving a strip of material into contact with the spindle; and means rotating the spindle for wrapping the strip onto the spindle in a compact scroll and thereby removing the strip from the shear.

15. The invention as set forth in claim 14 wherein the means for moving the strip includes a drive roller located at one side of the shear, and means for rotating the drive roller in contact with the strip about an axis transverse to the major axis.

16. The invention as set forth in claim 15 further including means positively gripping the strip as the strip is cut by the shear for moving the strip along the shear in the direction of the major axis toward the drive roller.

17. The invention as set forth in claim 16 wherein the spindle and the drive roller include parallel axes of rotation and the drive roller is located adjacent the scrolling mechanism at the side of the shear.

18. The invention as set forth in claim 6 including means for moving the pinch roller into driving contact with the strip of scrap.

19. The method as set forth in claim 12 wherein step (b) includes directing the strip towards a scroll spindle and step (c) includes rotating the scroll spindle to wind the strip onto the spindle.

20. The method as set forth in claim 19 wherein the step of directing the strip towards the spindle includes driving a roller in contact with the strip.

21. The method as set forth in claim 19 further including the step of stripping the compact scroll from the spindle, said step of stripping including moving the spindle axially to contact a portion of the edge of the strip against an abutment surface.

22. The method as set forth in claim 21 wherein the step of rotating the spindle includes the steps of slidably supporting a length of the spindle in a sleeve and rotating the sleeve, and wherein the step of stripping includes moving the spindle axially within the sleeve.

23. The method as set forth in claim 19 wherein the step (b) further includes rotating the scroll spindle about an axis locating at one side of the shear adjacent the cutting blade.

24. The method as set forth in claim 23 further including the step of moving the scroll spindle relative to the shear to provide a clearance space for the strip wound onto the spindle.

25. The invention as set forth in claim 2 wherein the means rotating the spindle includes a gear and means constraining the spindle for rotation with the gear while permitting axial movement of the spindle relative to the gear; and including cylinder means for shifting the spindle axially relative to the gear.

26. The invention as set forth in claim 25 including a sleeve supported for rotation in the frame, and wherein said spindle is slidable axially within the sleeve.

27. The invention as set forth in claim 26 including key means for constraining the spindle for rotation with the sleeve and a second gear fixed to and for rotation with the sleeve, said second gear meshing with the first gear.

28. The invention as set forth in claim 4 wherein the spindle is shiftable axially relative to the scroller frame; and means for axially shifting the spindle to force the scroll therefrom.

29. The invention as set forth in claim 28 wherein the spindle includes a free end and the slot extends axially through to the free end to permit said one end of the metal strip directed into the slot to slide along the slot until the scroll is removed from the spindle.

30. The method as set forth in claim 13 wherein the step (b) includes moving the activated gripping mechanism in said direction.

31. The method as set forth in claim 12 wherein step (a) includes the step of preventing the strip from falling a substantial distance as the strip is severed from the sheet.

32. The method as set forth in claim 31 wherein the step of preventing the severed strip from falling includes activating a gripping mechanism adjacent the cutting blade to positively grip and hold the strip adjacent the shear.

* * * * *

UNITED STATES PATENT AND TRADEMARK OFFICE

CERTIFICATE OF CORRECTION

PATENT NO. : 4,550,881

DATED : 5 November 1985

INVENTOR(S) : Peter W. Boardman

It is certified that error appears in the above-identified patent and that said Letters Patent is hereby corrected as shown below:

Column 6, line 63, after "wherein", delete "the".

Column 8, line 13, change "locating" to -- located --.

Signed and Sealed this

*Twenty-fourth* Day of *June 1986*

[SEAL]

*Attest:*

DONALD J. QUIGG

*Attesting Officer*

*Commissioner of Patents and Trademarks*